US006991188B2

(12) United States Patent
Kobayashi et al.

(10) Patent No.: US 6,991,188 B2
(45) Date of Patent: Jan. 31, 2006

(54) ENGINE FUEL INJECTION VALVE AND MANUFACTURING METHOD FOR NOZZLE PLATE USED FOR THE SAME INJECTION VALVE

(75) Inventors: Takayuki Kobayashi, Gunma (JP); Masatoshi Yanase, Gunma (JP); Hiroaki Hirata, Gunma (JP); Hiroki Nakagane, Gunma (JP)

(73) Assignee: Hitachi, Ltd., Tokyo-to (JP)

( * ) Notice: Subject to any disclaimer, the term of this patent is extended or adjusted under 35 U.S.C. 154(b) by 560 days.

(21) Appl. No.: 09/908,914

(22) Filed: Jul. 20, 2001

(65) Prior Publication Data

US 2002/0020766 A1 Feb. 21, 2002

(30) Foreign Application Priority Data

Aug. 16, 2000 (JP) ..... 2000-246893

(51) Int. Cl.
*B05B 1/00* (2006.01)

(52) U.S. Cl. ..... 239/596; 239/494; 239/497; 239/552; 239/584; 239/585.1; 239/601; 239/900; 239/533.12

(58) Field of Classification Search ..... 239/491, 239/494, 497, 552, 596, 585.1, 585.4, 584, 239/900, 601, 533.12; 29/890.142, 888.4
See application file for complete search history.

(56) References Cited

U.S. PATENT DOCUMENTS 5,626,295 A * 5/1997 Heyse et al. ..... 239/596
5,685,491 A * 11/1997 Marks et al. ..... 239/596
5,752,316 A * 5/1998 Takagi et al. ..... 29/888.4
6,131,827 A * 10/2000 Kurita et al. ..... 239/596
6,405,946 B1 * 6/2002 Harata et al. ..... 239/596

FOREIGN PATENT DOCUMENTS

JP 3-194163 8/1991

* cited by examiner

*Primary Examiner*—Steven J. Ganey
(74) *Attorney, Agent, or Firm*—Foley & Lardner LLP

(57) ABSTRACT

In a fuel injection valve, a substantially arc-shaped chamfered portion in a substantially arc shape of cross section is formed on an edge of an inner wall portion of each opening end of a corresponding nozzle hole of a nozzle plate to further expand a whole diameter of an injection stream of fuel passed through a plurality of obliquely penetrated nozzle holes. In a manufacturing method for the nozzle plate, circulating a fluid mixed with an abrasive through each nozzle hole is carried out to polish opening ends of the respective nozzle holes which are faced against the external of the fuel injection valve in a form of substantially arc shape of cross section with the abrasive. Furthermore, grinding the respective major surfaces of a punched plate material which becomes the nozzle plate together with vicinities to the respective opening ends of the nozzle holes is carried out.

12 Claims, 9 Drawing Sheets

ENGINE FUEL INJECTION VALVE AND MANUFACTURING METHOD FOR NOZZLE PLATE USED FOR THE SAME INJECTION VALVE

BACKGROUND OF THE INVENTION a) Field of the Invention

The present invention relates to a fuel injection valve suitable for a fuel injection into an internal combustion engine of an automotive vehicle and a manufacturing method for a nozzle plate to be assembled into the fuel injection valve.

b) Description of the Related Art

A general fuel injection valve (normally called, fuel injector but also called fuel injection valve) used in an automotive engine includes a cylindrical valve casing having a fuel passage in its axial direction; a valve seat member having a valve seat and an injection outlet opening, the valve seat being disposed on an inner periphery of the valve casing at a tip end so as to enclose the injection outlet opening; a nozzle plate disposed at the tip of the valve casing so as to be faced against the injection outlet opening of the valve seat member and having a plurality of nozzle through-holes to inject fuel toward an external to the valve casing from the injection outlet opening; and a valve body to operatively be separated from the valve seat in response to an operation of an electromagnetic actuator installed within the fuel passage of the valve casing.

In such a kind of fuel injection valve as described above, the nozzle plate is formed by pressing a thin metallic plate and is attached onto the tip of the valve casing at a position so as to enclose the injection outlet opening of the valve seat member. In addition, a plurality of nozzle holes to inject fuel are penetrated through the nozzle plate.

A Japanese Patent Application First Publication No. Heisei 3-194163 published on Aug. 23, 1991 exemplifies a manufacturing process of the nozzle holes on the nozzle plate of the fuel injection valve.

A punching process is carried out for the nozzle plate using a punch so that the plurality of nozzle holes, each having a predetermined hole diameter and being inclined by a predetermined inclination angle with respect to a thickness direction of the nozzle plate and, therefore, a flow quantity of fuel and injection direction of the fuel injection valve can be determined.

During a valve opening of the valve body, the fuel supplied into the valve casing is injected from each nozzle hole toward an approximately intake port portion of the engine. At this time, the nozzle holes are so constructed that the fuel is injecting at a predetermined flow quantity according to their hole diameters and minute particles (granulations) of fuel can be achieved.

At a time of manufacturing the nozzle plate, the nozzle plate is punched in an opposite direction to the fuel injection direction of the fuel injection valve and the nozzle holes are opened on their front and rear surfaces. At this time, since one of the surface opening ends of the nozzle opening ends of fuel which is placed at outflow opening ends of fuel is an inlet side of the punch, a recess, viz., called a shear droop is formed in the vicinity to the outflow opening ends.

To avoid such manufacturing defects, the above-described previously proposed nozzle holes, a side surface which is placed at the outflow side of fuel from both surfaces of the nozzle plate is ground to scrape the shear droops placed in the vicinity to the nozzle holes.

SUMMARY OF THE INVENTION

An automotive vehicular engine field has demanded that since as each hole diameter of the nozzle holes becomes finer (smaller), the particles of the injected fuel becomes more minute, each nozzle hole is formed as small as possible to granulate injected fuel into minute particles and its combustibility can be improved.

However, even if the nozzle holes are formed to become small and a minute amount of foreign matters is slightly mixed, the nozzle holes are easier to be clogged. Hence, there is a limitation to granulate injected fuel into minute particles. In addition, the particles injected from the minute nozzle holes are high particle densities at a narrow region. Hence, the particle diameters are easy to become large with the fuel particles combined after the fuel injection.

Furthermore, since the particles of fuel injected from the minute nozzle holes are high particle densities at a narrow region, the particle diameters are easy to be enlarged with the combination after the fuel injection.

It is difficult to granulate the injected fuel sufficiently into minute particles only merely by forming the small hole diameters of nozzle holes but the nozzle holes are made to be clogged, thereby a reliability being reduced.

In addition, since in the previously proposed nozzle plate manufacturing method, each nozzle hole is punched in a direction opposite to the fuel injection direction using, for example, the punch, a peripheral wall of each nozzle hole becomes easy to be rough shear cross section with respect to a circulating direction of fuel.

However, at the opening ends at the nozzle hole inflow side of fuel which are outlet opening sides of the punch, peripheral walls of the nozzle holes provide fracture-planes of a multiple number of convex and recess cracks and defects are found at each corner of the opening ends.

No grinding off of the nozzle plate is found during the grinding process of the nozzle plate.

Therefore, when the fuel is injected through each nozzle hole, a stream of fuel becomes easy to be disturbed due to a rough peripheral wall of each nozzle hole and is difficult to stabilize the fuel injection.

These defect portions at the inflow side of the nozzle plate are not ground during the scrape process.

It is an object of the present invention to provide improved fuel injection valve and a manufacturing method of the fuel injection valve, particularly, the manufacturing method of its nozzle which can stably inject the fuel at the minute particle from the nozzle plate and which can improve a performance of the injection valve and its reliability.

These objects can be achieved by providing a fuel injection valve comprising: a substantially cylindrical valve casing in which a fuel flow passage is provided in its axial direction; a valve seat member comprising a valve seat installed within the fuel flow passage of one end of the cylindrical valve casing to enable a seating of a valve body and an injection outlet opening with a periphery of which the valve seat is enclosed, the valve body being disposed within the fuel flow passage of the valve casing to be operatively separated from the valve seat to open the fuel injection valve to inject the fuel in the fuel flow passage of the valve casing in response to an activation of an actuator; a nozzle plate faced against the injection outlet opening and on both surfaces of which openings of a plurality of nozzle holes are formed, the fuel being injected through the nozzle holes when the fuel injection valve is open; and a substantially arc-shaped chamfered portion in a substantially arc shape of cross section formed on an edge of an inner wall portion of each opening end of the corresponding nozzle hole of the nozzle plate to further expand a whole diameter of an injection stream of fuel passed through the nozzle holes.

The above-described object can also be achieved by providing a method of manufacturing a nozzle plate for use in a fuel injection valve, the fuel injection valve comprising: a substantially cylindrical valve casing in which a fuel flow passage is provided in its axial direction; a valve seat member comprising a valve seat installed within the fuel flow passage of one end of the cylindrical valve casing to enable a seating of a valve body and an injection outlet opening with a periphery of which the valve seat is enclosed, the valve body being disposed within the fuel flow passage of the valve casing to be operatively separated from the valve seat to open the fuel injection valve to inject the fuel in the fuel flow passage of the valve casing in response to an activation of an actuator; a nozzle plate faced against the injection outlet opening and on both surfaces of which openings of a plurality of nozzle holes are formed, the fuel being injected through the nozzle holes when the fuel injection valve is open; and a substantially arc-shaped chamfered portion in a substantially arc shape of cross section formed on an edge of an inner wall portion of each opening end of the corresponding nozzle hole of the nozzle plate to further expand a whole diameter of an injection stream of fuel passed through the nozzle holes, the manufacturing method comprising: using a punch to penetrate a plate material constituting the nozzle plate and which is mounted on a punch die; repeatedly inserting a tip of the punch into a punch hole of the die to form the plurality of nozzle holes; and circulating a fluid mixed with an abrasive through each nozzle hole to polish opening ends of the respective nozzle holes which are faced against the external of the fuel injection valve in a form of substantially arc shape of cross section with the abrasive to form the substantially arc-shaped chamfered portion on an edge of the inner wall portion of each opening end of the corresponding nozzle hole of the nozzle plate.

The above-described object can also be achieved by providing a method of manufacturing a nozzle plate for use in a fuel injection valve, the manufacturing method comprising: penetrating a plate material to form a plurality of nozzle holes opened to both major surfaces of the plate material; and circulating a fluid mixed with an abrasive through each nozzle hole to polish opening ends of the respective nozzle holes which are faced against the external shape of cross section with the abrasive to form the substantially arc-shaped chamfered portion on an edge of the inner wall portion of each opening end of the corresponding nozzle hole of the nozzle plate.

The above-described object can also be achieved by providing a method of manufacturing a nozzle plate for use in a fuel injection valve, the fuel injection valve comprising: a substantially cylindrical valve casing in which a fuel flow passage is provided in its axial direction; a valve seat member comprising a valve seat installed within the fuel flow passage of one end of the cylindrical valve casing to enable a seating of a valve body and an injection outlet opening with a periphery of which the valve seat is enclosed, the valve body being disposed within the fuel flow passage of the valve casing to be operatively separated from the valve seat to open the fuel injection valve to inject the fuel in the fuel flow passage of the valve casing in response to an activation of an actuator; and a nozzle plate faced against the injection outlet opening and on both surfaces of which openings of a plurality of nozzle holes are formed, the fuel being injected through the nozzle holes when the fuel injection valve is open, the manufacturing method comprising: using a punch to penetrate obliquely a plate material which becomes the nozzle plate and is mounted on a die toward a direction of the injection stream of fuel to provide the plurality of obliquely penetrated nozzle holes opened to both major surfaces of the plate material; and grinding the respective major surfaces of the punched plate material together with vicinities to the respective opening ends of the nozzle holes.

The above-described object can also be achieved by providing a method of manufacturing a nozzle plate for use in a fuel injection valve, the manufacturing method comprising: using a punch to penetrate obliquely a plate material which becomes the nozzle plate and is mounted on a die toward a direction of the injection stream of fuel to provide the plurality of obliquely penetrated nozzle holes opened to both major surfaces of the plate material; and grinding the respective major surfaces of the punched plate material together with vicinities to the respective opening ends of the nozzle holes.

The other objects and features of this invention will become understood from the following description with reference to the accompanying drawings.

DETAILED DESCRIPTION OF THE PREFERRED EMBODIMENTS

Figure 1:
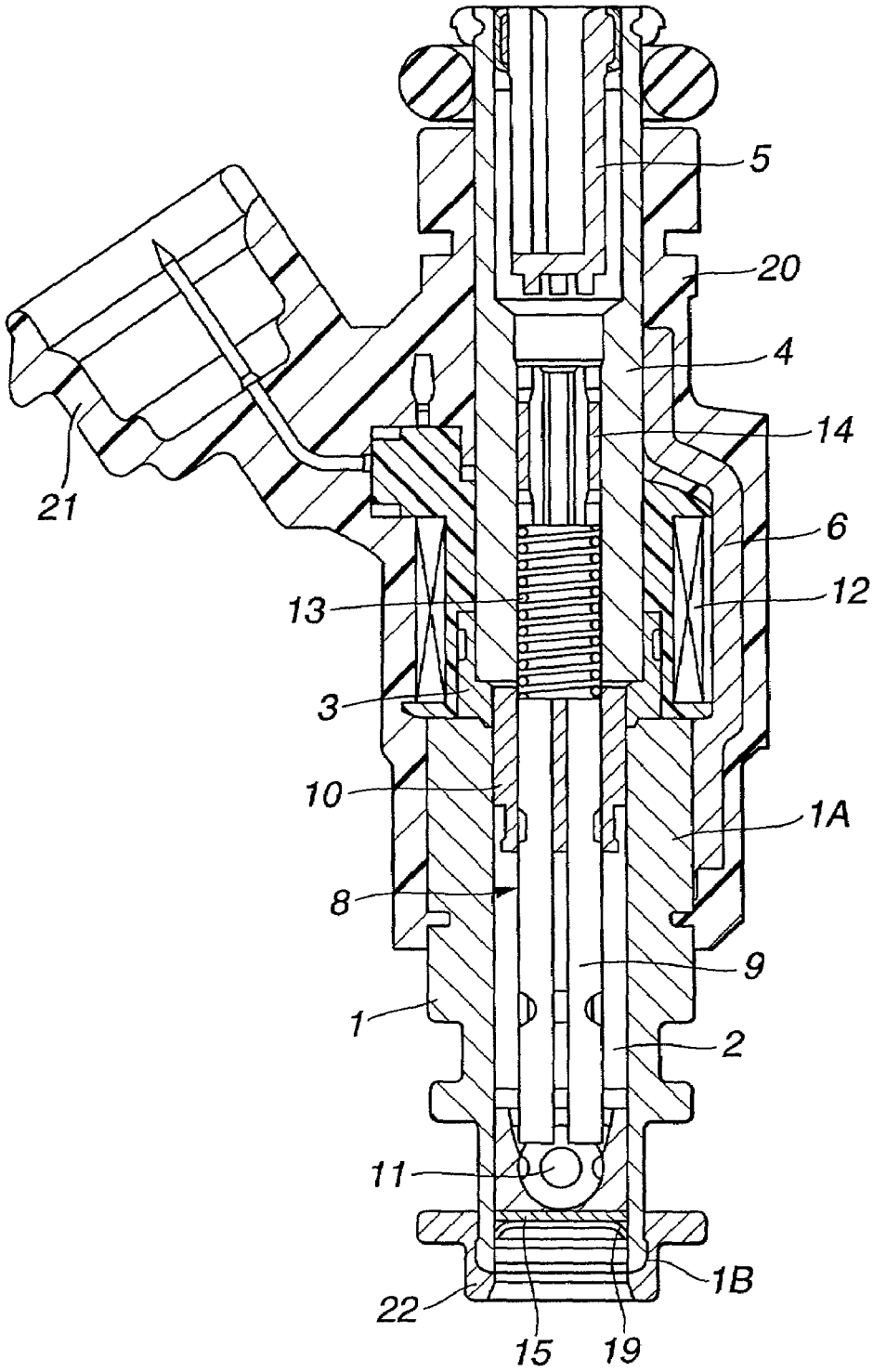
FIG. 1 is a longitudinal cross sectional view of a fuel injection valve in a first preferred embodiment according to the present invention.
Figure 2:
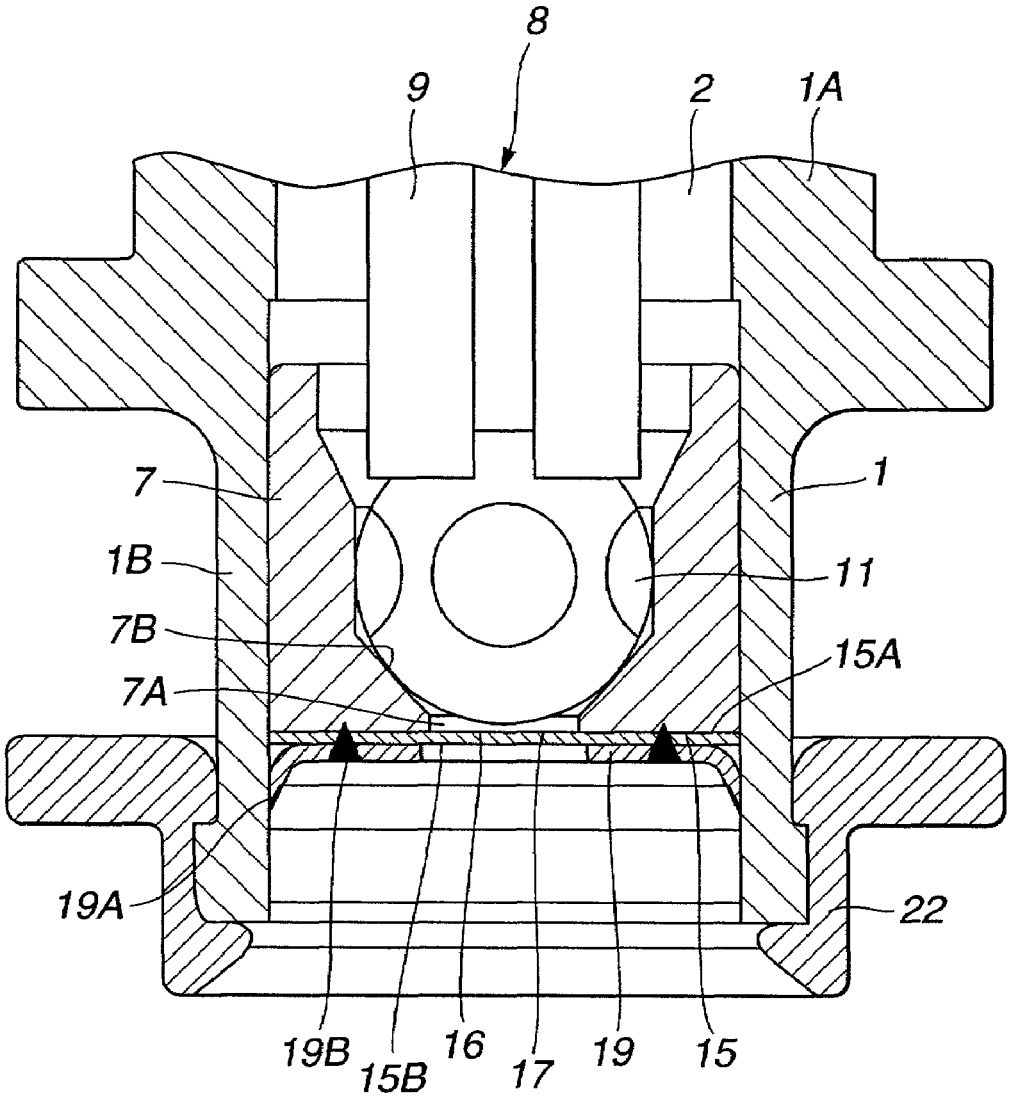
FIG. 2 is an expanded cross sectional view of an essential part of a tip of cylindrical valve casing shown in FIG. 1.
Figure 3:
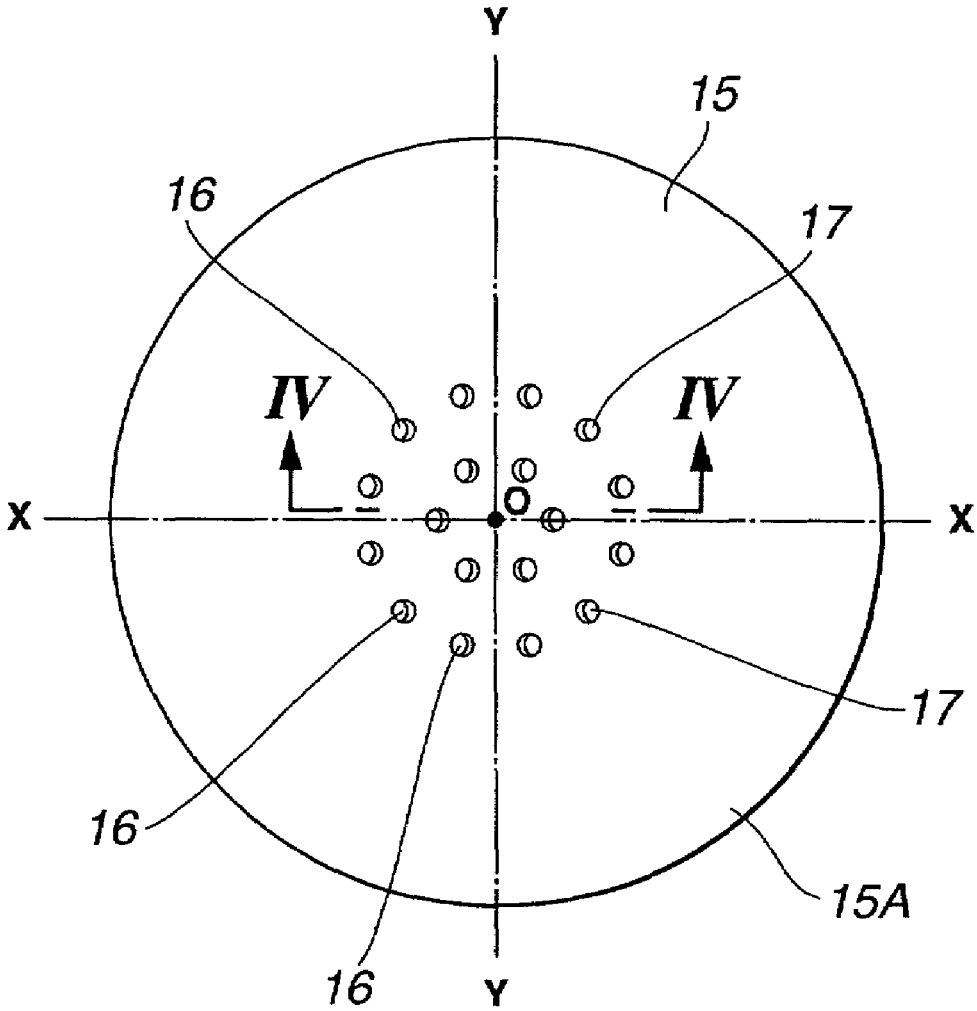
FIG. 3 is a plan view of a nozzle plate shown in FIGS. 1 and 2.

Reference will hereinafter be made to the drawings in order to facilitate a better understanding of the present invention.

FIGS. 1 through 11 show a fuel injection valve in a first preferred embodiment according to the present invention and a manufacturing method of a nozzle plate used in the fuel injection valve.

A cylindrical valve casing 1 as a major body of the fuel injection valve is formed, for example, in a stepped cylindrical shape with a magnetic material such as electromagnetic stainless steel.

The valve casing 1 comprises: a large-diameter cylindrical envelope 1A onto a basic end of which a resin covering is attached; a small-diameter cylindrical envelope 1B integrally fixed at a tip of the large-diameter envelope 1A; and a fuel passage 2 through which a valve body is inserted and which is axially disposed.

A cylindrical linkage member 3 fixedly attached at a basic end of the valve casing 1 is formed of the non-magnetic material and is interposed between the valve casing 1 and a fuel inflow pipe 4.

A cylindrical fuel inflow pipe 4 formed with a magnetic material such as an electromagnetic stainless steel is fixed at the basic end of the valve casing 1 using the linkage member 3. Its tip end is communicated to the fuel passage 2. A fuel filter 5 is installed around the inner periphery of the basic end of fuel inflow pipe 4.

Both fuel inflow pipe 4 and valve casing 1 are magnetically linked via a linkage core made of a magnetic metallic piece attached at outer peripheral sides. When a power supply to an electromagnetic coil 12 as will be described later is turned on, a closed magnetic path is formed among the valve casing 1, the fuel inflow pipe 4, the linkage core 6, and the adsorption portion 10 as will be described later.

A substantially cylindrical valve seat member 7 is disposed within a small-diameter portion 1B of the valve casing 1 with a small gap provided against the small-diameter portion 1B. A circular injection outlet opening 7A is formed, as typically shown in FIG. 2. A substantially truncated cone shaped valve seat 7B is installed on the inner periphery of the valve seat member 7 so as to enclose the injection outlet opening 7A.

A valve body 8 inserted within the fuel passage 2 of the valve casing 1. The valve body 8 includes: as shown in FIG. 1, a valve axle 9 formed substantially cylindrically with a metallic plate folded; a cylindrical adsorption portion 10 fixedly attached onto the basic end of the valve axle 9; and a spherical valve body 11 fixedly installed at a tip of the valve axle 9 for separately landing the valve seat 7B of the valve seat member 7. The basic end surface of the adsorption portion 10 is faced toward the fuel inflow pipe 4 with the axial gap provided and the dimension of the gap is previously adjusted as a light quantity of the valve body 8. A plurality of chamfered portions are formed at an outer periphery of the valve portion 11. When the adsorption portion 10 is magnetically attracted with the electromagnetic coil 12, the valve body 8 displaces in the axial direction thereof against a biasing force exerted by a valve spring 13. The valve is opened with a constant light quantity form a valve closure portion at which the valve portion 11 is seated on the valve seat 7B of the valve seat member 7 to a valve open position at which the adsorption portion 10 is contacted on the fuel inflow pipe 4.

A valve spring 13 comprises a compressive spring disposed within a fuel inflow pipe 4. The valve spring 3 is disposed between a cylindrical body 14 fixedly attached onto an upstream side of the fuel inflow pipe 4 and a basic end of the valve body 8 to bias the valve body 8 in the open direction.

A nozzle plate 15 is fixedly attached within the small-diameter cylindrical envelope 1B of the valve casing 1 via a press plate 19. The nozzle plate 15 is formed with a predetermined wall thickness t0 between 0.05 mm and 0.25 mm, for example, and is provided with a side surface 15A and the other side surface 15B.

In addition, a nozzle plate 15 is faced against the injection outlet opening 7A with one side surface 15A attached onto the valve seat member 7 and exposed to an external of the valve casing 1 via an inner peripheral side of the press plate 19.

The nozzle plate 15 serves to inject through nozzle holes 16, 16, - - - and 17, 17, - - - the fuel flowing out of the injection outlet opening 7A of the valve seat member 7 in a state of micro particles. A multiple number of left nozzle holes 16, m 16, - - - are nozzle plate 15 by penetrating the nozzle plate 15 in its plate thickness direction. As viewed from FIGS. 3 through 5, left nozzle holes 16 are disposed at left side with respect to an Y—Y axis extended vertically along a center line 0—0 of, for example, the nozzle plate 15 and arranged in a double concentric circular form of right nozzle holes 17, 17, - - - .

Figure 4:
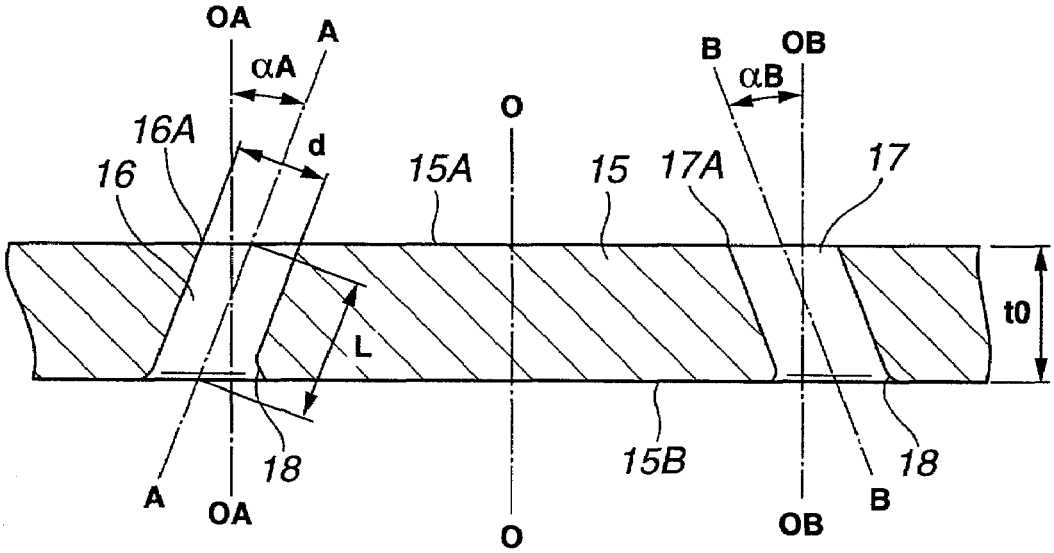
FIG. 4 is an expanded cross sectional view of a center portion of the nozzle plate of the fuel injection valve as viewed from an arrow-marked direction of IV—IV shown in FIG. 3.

Each left nozzle hole 16 is, as shown in FIG. 4, is formed with a straight line penetrated hole having a cylindrical peripheral wall with an axial line A—A as a center. The axial line is inclined in a leftward direction by a predetermined inclination angle $\alpha$A with respect to a line 0A—0A parallel to a center line 0—0 of each left nozzle hole 15. The predetermined inclination angle $\alpha$A, e.g., corresponds to the arrangement of intake port of the engine. In addition, each left nozzle 16 has a predetermined hole diameter d of approximately 0.1 mm through 0.2 mm and a length dimension L positioned between one side surface 15A and the other side surface 15B of the nozzle plate 15.

A multiple number of right nozzle holes 17, 17, - - - formed in substantially same manner as the left nozzle holes 16. Each right nozzle hole 17 is disposed in more rightward direction than the Y—Y axial line of, for example, the nozzle plate 15. Each right nozzle hole 17 is formed by penetrating the nozzle plate 15 to have the hole diameter of d. In addition, an axial line B—B of each right nozzle hole 17 is inclined by a predetermined inclination angle $\alpha$B in the rightward direction of an X axis with respect to the line 0B—0B parallel to the center line 0—0 of the nozzle plate 15. The two predetermined inclination angles αA and αB of both of the Left and right nozzle holes serve to define branch Angles θ1.

Each right nozzle hole 17 is provided with the inflow opening end 17A opened to one side surface 15A of the nozzle plate 15 and with an arch-shaped chamfered portion 18 at the outflow opening end opened to the other side surface 15B of the nozzle plate 15.

Figure 5:
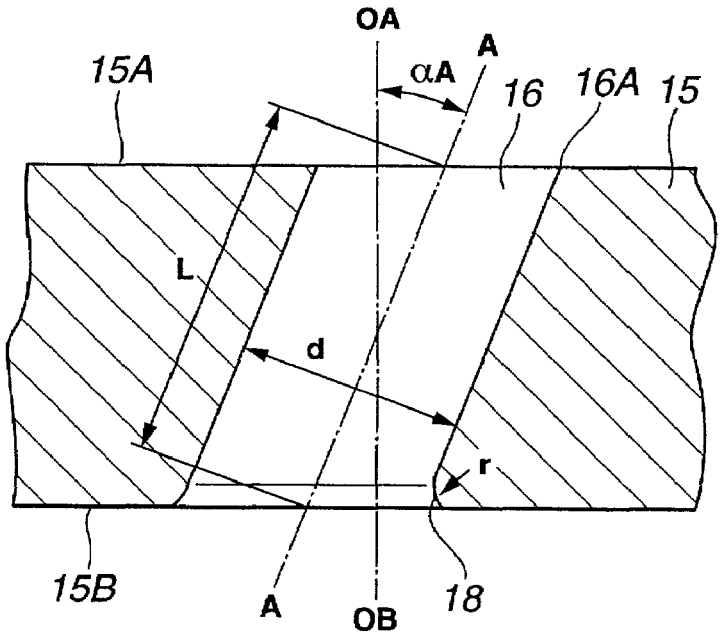
FIG. 5 is an expanded cross sectional view of the nozzle plate shown in FIG. 4 representing arc-shaped chamfered portion of left nozzle holes of the nozzle plate.
Figure 6:
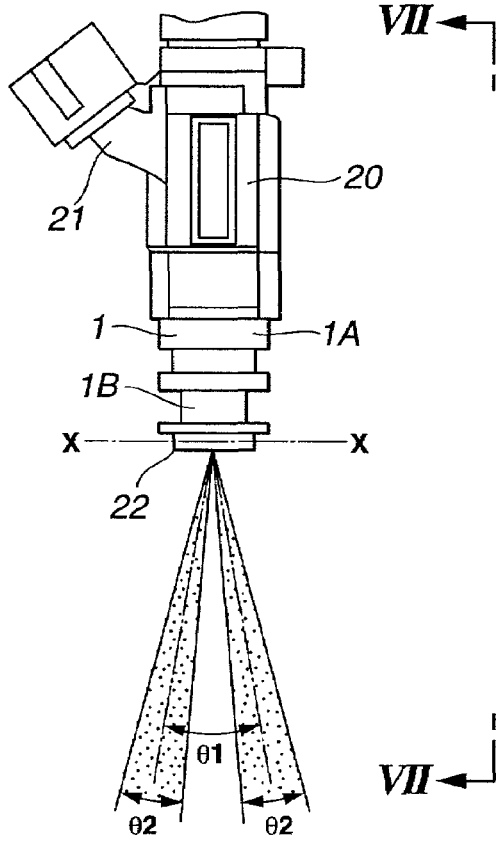
FIG. 6 is an elevation view representing an injection state in which a fuel is branched into rightward and leftward directions from the fuel injection valve shown in FIGS. 1 through 5.
Figure 7:
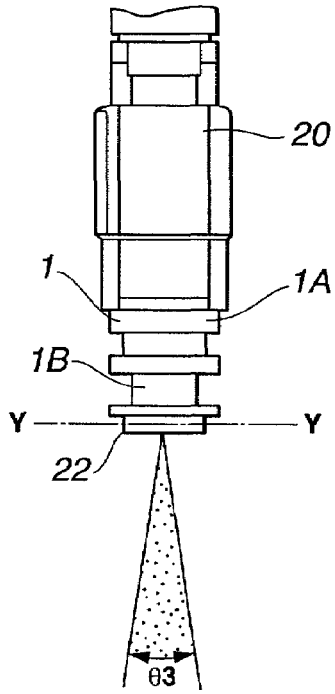
FIG. 7 is a right side view of the fuel injection valve shown in FIGS. 1 through 6 as viewed from an arrow-marked direction of VII—VII shown in FIG. 6.

Each arc-shaped chamfered portion 18 is provided on corresponding one of the respective nozzle holes 16 and 17. Each arc-shaped chamfered portion 18 is, as shown in FIGS. 4 and 5, formed by chamfering the outflow side opening end of the corresponding one of nozzle boles 16 and 17 using, for example, horning, buff rolling, or grinding material or other polishing means and is extended over a whole periphery of the outflow opening end in a curved surface in an arc shape of substantially arc shape and having a predetermined radius of curvature r.

The arc-shaped chamfered portion 18 is progressively expanded in the outflow direction of fuel placed in the vicinity to the other side surface 15B of the nozzle plate 15 of each nozzle hole 16 and 17. The hole diameter of this diameter expanded portion is slightly larger than the hole diameter d of a midway portion placed in the vicinity to the other side surface 15B of the nozzle plate 15.

In addition, the radius of curvature r of the arc-shaped chamfered portion 18 is formed with a predetermined dimensional ratio with respect to the hole diameter d of the nozzle holes 16 and 17.

The dimensional ratio (r/d) is previously set using an experimental data shown in FIG. 8 as will be described later so as to fall in a range, for example, approximately 0.1 through 0.28, preferably, in a range between about 0.14 to 0.2 mm.

Each arc-shaped chamfered portion 18 serves to hold a predetermined flow quantity of fuel and injection direction defined according to the hole diameter d, the inclination angles of αA and αB when the fuel is injected through each nozzle hole 16 and 17 and promote the micro particles of fuel with combinations of fuel particles suppressed by slightly widening the injection pattern along the surface of each arc-shaped chamfered portion 18.

On the other hand, a pressure plate 19 is formed of a substantially circular metallic plate and is welded within a small diameter cylindrical portion 1B of the valve casing 1. An inner peripheral portion of the pressure plate 19 is welded on a tip surface of the valve seat member 7 together with the nozzle plate 15 and valve seat member 7 are fixed within the valve casing 1.

A resin covering 20 is attached so as to enclose the large-diameter cylindrical portion 1*a* of the valve casing 1. The resin covering 20 is provided with a connector 21 as shown in FIG. 1.

A protector 22 is attached onto the small-diameter cylindrical portion 1B of the valve casing 1 to cover the nozzle plate 15.

The fuel injection valve in the preferred embodiment is so constructed as described above and its operation will be described below.

First, the fuel is supplied from a basic end of a fuel inflow pipe 4. When the power is supplied to the electromagnetic coil 12 via the connector 21, the absorption portion 10 of the valve body 8 is magnetically attracted via the valve casing 1, the fuel inflow pipe 4, and the linkage core 6 with the electromagnetic coil 12. The valve body 8 is, then, opened against the valve spring 13. The fuel within the fuel passage 2 is injected externally from, the injection outlet opening 7A of the valve seat member 7 via the nozzle holes 16 and 17 of the nozzle plate 15.

The fuel injection is carried out by branching the injected fuel into both left and right directions (X-axis direction) by branch angles αA and αB of nozzle holes 16 and 17. These branched fuel provides a widened substantially truncated cone injection pattern having the expansion angle of θ2 in the X-axis direction and in the Y-axis direction θ3 in the Y-axis direction and is injected in an intake port side of the engine.

In this case, the injection direction is determined by circulating the injected fuel from the left nozzle holes 16, 16, - - - by the length dimension L within the left nozzle holes 16 having the respective predetermined inclination angles of αA.

When the fuel is injected externally from the left nozzle holes 16, 16, 16 - - - , an injection stream of fuel is expanded over a constant region along the surface of the arc shaped chamfered portion 18.

Hence, excessive densities of the particles of fuel during the injection can be suppressed and the combinations of particles can be reduced.

Thus, the fuel injected from the respective left nozzle holes 16 form the injection stream along the axial line A—A and holds the micro particles state via the respective arc-shaped chamfered portion 18. In the same manner as the injected fuel from the right nozzle holes 17, 17, - - - , the injection stream is formed along the axial line B—B direction and each arc-shaped chamfered portion 18 can promote micro particles of fuel.

The relationship between the radius of curvature r of each arc-shaped chamfered portion will be described below with reference to the experimental data shown in FIG. 8.

Figure 8:
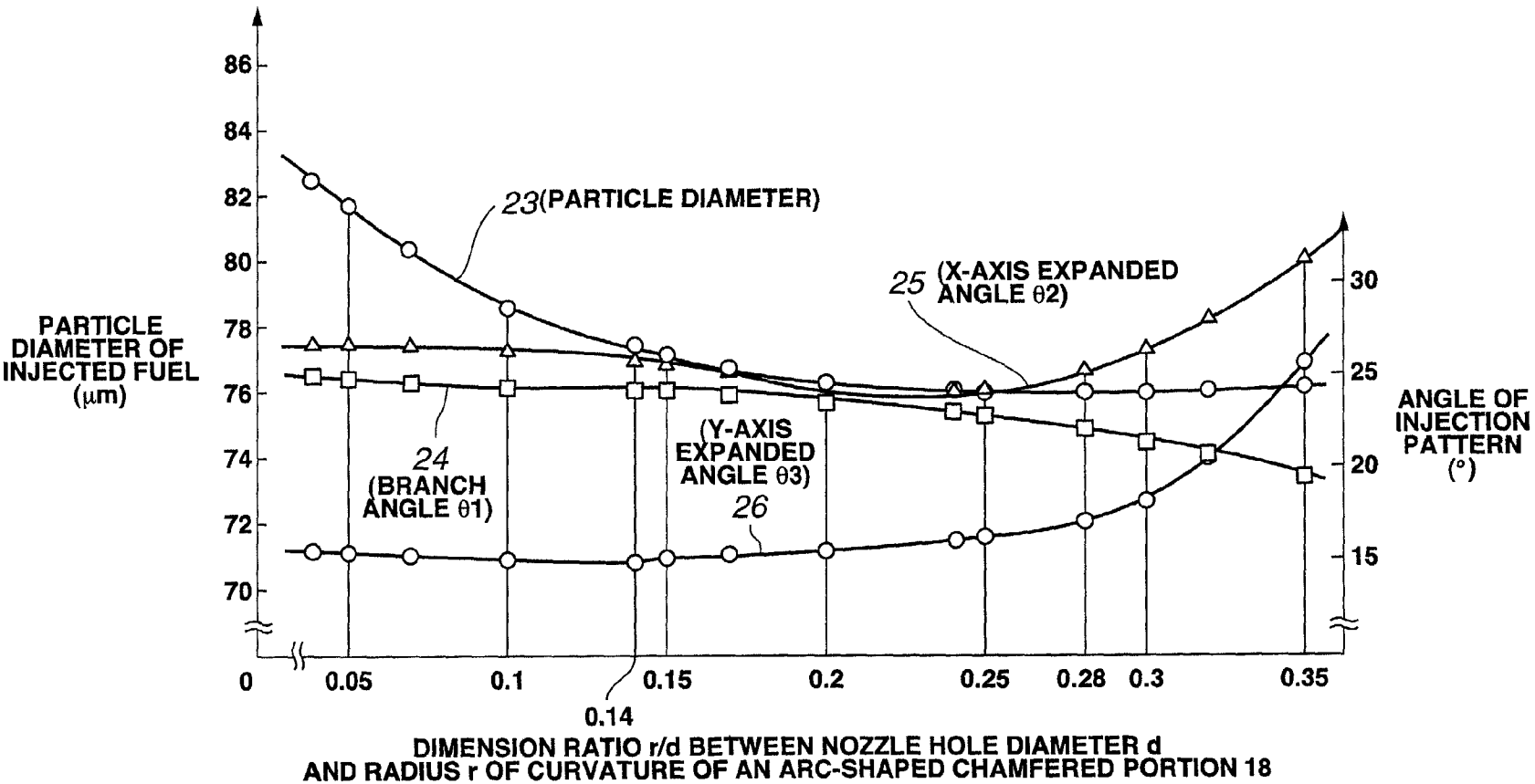
FIG. 8 is a characteristic graph representing a relationship from among a dimension ratio of a radius of curvature in an arc-shaped chamfered portion to a particle diameter of injected fuel and an angle of an injection pattern.

First, a particle diameter of the injected fuel becomes optimized, as shown in a characteristic line 23 of FIG. 8, when either the radius of curvature r of the arc-shaped chamfered portion 18 or the dimension ratio (r/d) of the radius of curvature r with respect to the hole diameter of the nozzle becomes large. For example, when the dimension ratio (r/d) is in excess of about 0.1, or preferably, about 0.14, the injected fuel can sufficiently be reduced to micro particles.

However, the branch angle θ1 of injection pattern and expansion angles θ2 and θ3 become unstable, as shown by characteristic lines 24, 25, and 26 of FIG. 8, as the radius of curvature r of each arc shape chamfered portion 18 becomes large. That is to say, since the injection pattern of fuel is expanded along the surface of the arc shaped chamfered portion 18, the dimension ratio (r/d) is in excess of approximately 0.2 and, at this time, the expansion angles θ2 and θ3 of the injection pattern are progressively increased. When the dimension ratio (r/d) is in excess of about 0.28, the expansion angles θ2 and θ3 are largely varied so that the branch angle θ1 of the injection pattern receives the ill influence therefrom.

Hence, as described in the preferred embodiment, the dimension ratio (r/d) of the hole diameter d of the nozzle holes 16 and 17 with respect to the radius of curvature r of the arc shaped chamfered portion 18 is set to fall within the range between, for example, 0.1 and 0.28 preferably between about 0.14 and 0.2.

Thus, while promoting the micro particles of the injected fuel by means of arc shaped chamfered portion 18, the injection direction of fuel and injection pattern can be held under an appropriate state.

Next, a manufacturing method of the nozzle plate 15 will be described below with reference to FIGS. 9 through 11.

Figure 9:
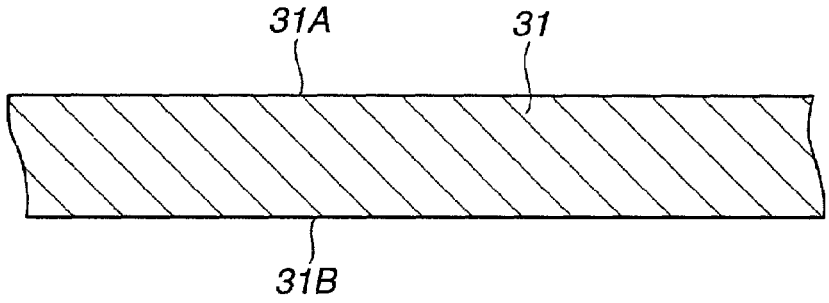
FIG. 9 is an expanded cross sectional view representing a state of formation of a plate material to become the nozzle plate of the fuel injection valve in a first preferred embodiment of a manufacturing method of the nozzle plate according to the present invention.

During a plate material forming process shown in FIG. 9, a plate material 31 which finally becomes the nozzle plate 15 is formed by such as a press tool.

Figure 10:
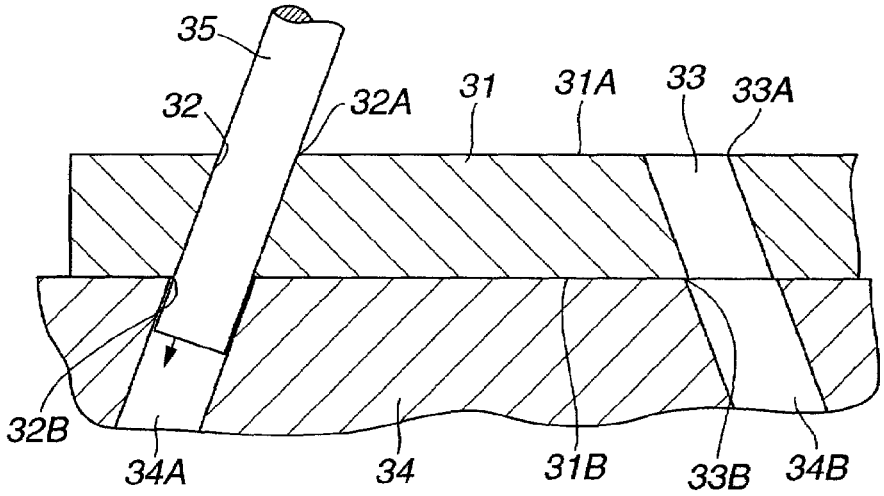
FIG. 10 is an expanded cross sectional view representing a state of the plate material in which a punch is used to penetrate nozzle holes during a punching process in the plate material in the case of the second embodiment shown in FIG. 9.

Next, during a punching process shown in FIG. 10, a plurality of through holes 32 and 33 are formed by punching the plate material 31 using a punching tool. During the punching process, a punch 35 is penetrated through the plate material 31 in such a manner that the punch 35 is directed from one side surface 31A in the injection direction of fuel, its tip of the punch 35 invaded into the corresponding punch holes 34A and 34B in the fuel injection direction. Hence, a through hole 32 having opening ends 32A and 32B and a through hole 33 are formed in the plate material.

Figure 11:
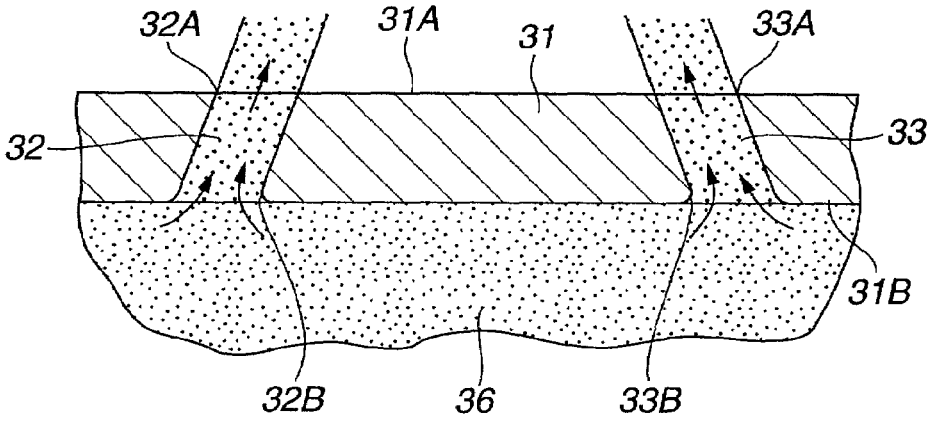
FIG. 11 is an expanded cross sectional view of the state of the plate material in which the arc-shaped chamfered portion using a polish fluid in a polish process.
Figure 12:
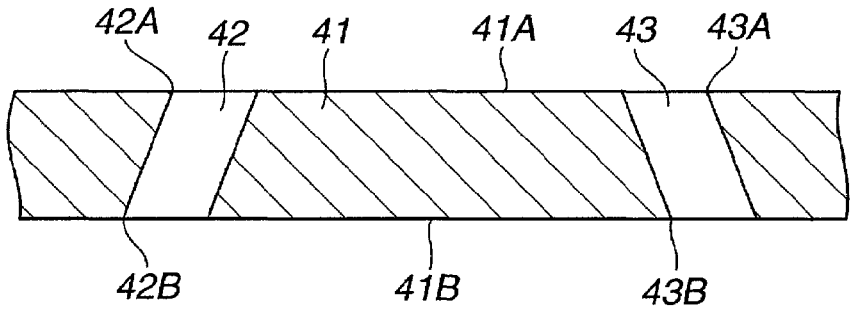
FIG. 12 is an expanded cross sectional view representing a state of the nozzle plate manufactured in a second preferred embodiment of the manufacturing method.

Next, during a polishing (grinding) press shown in FIG. 11, a fluid polish is, for example, used to cause a certain quantity of polish fluid 36 mixed with a multiple number of polish material particles (adhesive material particles) to flow in a direction reverse to the injection direction from the through holes 32 and 33 so that the outflow opening ends 32B and 33B are ground. Hence, the outflow opening ends in a substantially arc shape of cross section with the polish fluid 36 and, at these positions, the arc-shaped chamfered portions 18 are formed with the polish fluid 36.

In this case, the radius of curvature r of the arc-shaped chamfered portion 18 can be formed to a desired value by an appropriate settings off a pressure to be applied to the polish fluid 36, a time duration at which the polishing process is continued, and particle diameter of the abrasive material particles. Consequently, as shown in FIG. 4, the nozzle plate 15 on which the nozzle holes 16, 17, - - - and arc-shaped chamfered portions 18 can be manufactured.

Since, in the manufacturing method of the nozzle plate 15 in the first preferred embodiment, the arc-shaped chamfered portions 18 are disposed on the outflow opening ends, the flow quantity and injection direction can be determined according to the hole diameter. Length inclination angles $\alpha A$ and $\alpha B$, and length dimension L of the respective nozzle holes 16 and 17. The respective arc-shaped chamfered portions 18 can be hold the flow quantity and fuel injection direction of fuel and can expand the injection pattern at a constant range.

Hence, it is possible to decrease combinations of particles with the excessive densities of the injected fuel particles suppressed via the arc-shaped chamfered portions 18 so that the injected fuel can be promoted to be more granulated as the micro particles and the accurate injection of fuel toward the intake port of the engine can be made.

Consequently, a performance of the injection valve can be improved.

In this case, since the dimension ratio (r/d) of the radius of curvature r of each arc-shaped chamfered portion 18 to the hole diameter d of each nozzle hole 16 and 17 is set to fall within the above-described predetermined range, the arc-shaped chamfered portions 18 can provide an appropriate expansion of the injection pattern of fuel, can prevent an excessive expansion of the injection pattern over the wide range, and can inject stably the granulated fuel in a predetermined injection direction and in an injection pattern.

Since, during the polishing (grinding) process the polish tool such as the fluid polish is used, each arc-shaped chamfered portion 18 can easily be formed and the nozzle plate whose profile is stable can efficiently be manufactured.

Even in a case where the slid line and/or defects are formed on the peripheral walls and opening ends of the through holes 32 and 33 during the punching process, these portions can smoothly be finished with the above polishing carried out by the polish fluid 36. Thus, these fracture portions or defects can be eliminated so as to give no influence on the fuel injection.

Next, FIGS. 12 through 16 show a second preferred embodiment of the manufacturing method for the nozzle plate 15 of the fuel injection valve.

In the second embodiment, both surfaces of the plate material are ground in the plate thickness direction.

The nozzle plate 41 manufactured using the manufacturing method in the second embodiment is of, for example, the circular metallic plate, in the same manner as the nozzle plate described in the first embodiment. On the nozzle plate 42, the plurality of left nozzle holes 42 and right nozzle holes 43 are punched. Each nozzle hole 42 and 43 is a straight penetrated hole inclined by the predetermined inclination angle with respect to the plate thickness direction.

Each left nozzle hole 42 is provided with inflow opening ends 42A opened to one side surface 41A of the nozzle plate 41 positioned at the inflow side of fuel and the outflow opening ends 42B opened to the other side surface 41B positioned at the outflow position of fuel. In addition, the right nozzle holes 43 are positioned with opening ends 43A and 43B positioned on the outflow side of fuel. The opening ends 42A, 42B, 43A, and 43B of the nozzle holes 42 and 43 are of substantially pointed edge shapes.

The nozzle plate 41 is provided at tip ends of the casing 1. When the valve body 8 is opened, the fuel streamed out from the injection outlet opening 7A of the valve seat member 7 is injected under the micro particles (granulation state) from the respective nozzle holes 42 and 43.

The nozzle plate 41 to which the method of manufacturing the fuel injection valve is applicable has the above-described structure. The method of manufacturing the nozzle plate 41 will be described with reference to FIGS. 13 through 16.

Figure 13:
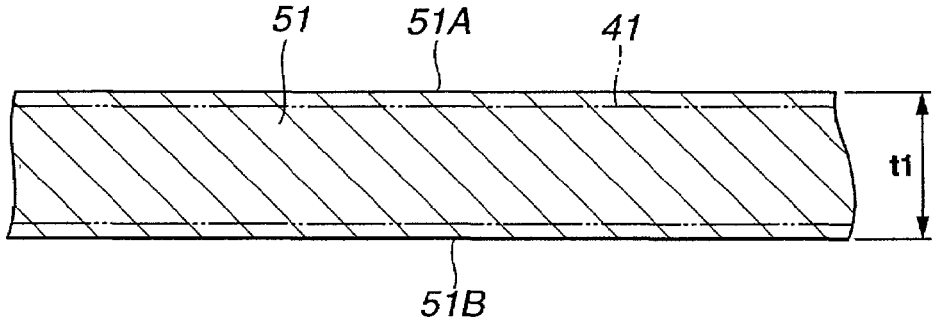
FIG. 13 is an expanded cross sectional view of a state of he plate material which is thicker than the nozzle plate during a plate material forming process in the second embodiment shown in FIG. 12.

First, during the plate material forming process shown in FIG. 13, the metallic plate is processed by a press forming so as to form a plate material 51 which becomes the nozzle plate 41. In this case, the plate material 51 is provided with the plate thickness t1 which is formed to become thicker than the nozzle plate 41.

Figure 14:
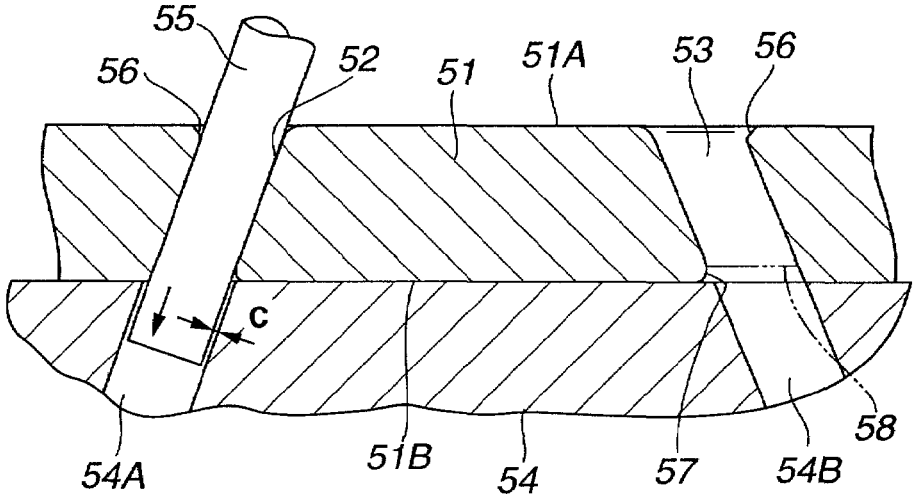
FIG. 14 is an expanded cross sectional view representing a state of a shear droop and a defect developed during the punching in the nozzle plate in the second embodiment shown in FIGS. 12 and 13.

Next, during the punch process shown in FIG. 14, the punching is carried out for the plate material 51 in the substantially same manner as the punch process carried out in the first embodiment so that the plurality of penetrated holes 52 and 53 are punched. In this case, a predetermined clearance C of, for example, about 1 through 10 $\mu$m is formed as a circular gap between punch holes 54A and 54B of the die 54 used in the punching process and punch 55.

During this process, the punch 55 is penetrated in the injection direction of fuel from the one side surface 51A of the plate material 51 toward the other side surface 51B. Consequently, a convexed shear droop 56 is often formed on the surrounding portion of the inflow opening ends of the through holes 52 and 53. Defects 57 and facture-plane 58 are often formed in the proximities to the outflow opening ends.

Figure 15:
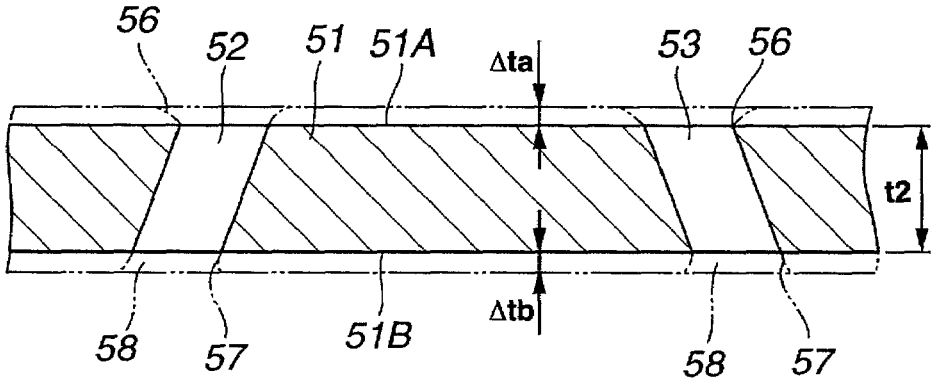
FIG. 15 is an expanded cross sectional view representing the state in which both surfaces of the plate material during a grinding process in the second embodiment shown in FIGS. 12, 13, and 14.

During the polish process shown in FIG. 15, the one surface (front) 51A of the plate material and the other (rear) surface 51B are ground to scrap off shear droop 56, deflects 57, and fracture plane 58, and so forth.

In this case, a grinding depth $\Delta ta$ of the one surface 51A is defined in the following equation 1 using the plate thickness t1 of, for example, the plate material 51.

$$0.1 \times t1 \geqq \Delta ta \geqq 0 \quad (1)$$

An upper limit value (0.1×t1) of the grinding depth is a limitation value to stabilize the injection direction of fuel by securing the length dimension of the nozzle holes 42 and 43 sufficiently.

On the other hand, the grinding depth Δtb of the other surface 51B is determined according to the following equation of (2) using, for example, the plate thickness t1 of the plate material 51 and the valve clearance C of the punch 55.

$$0.2\times t1 \geqq \Delta ta \geqq 2\times C \quad (2)$$

In this case, the upper limit value (0.2×t1) of the grinding depth Δtb is set substantially for the same reason in the case of the grinding depth Δta.

The deflects 57 and facture-plane 58 are set according to the clearance C between the punch 55 and the die 54.

The lower limit value (2×C) of the grinding depth Δta is set according to the clearance C.

Consequently, upon the completion of the grinding process, the plate thickness t1 of the plate material 51 is ground up to the plate thickness t2. Hence, since the shear droop 56, the defects 57, and fracture-plane are scrap off, the nozzle plate 41 having the substantially pointed edge shape of the opening ends 42A, 42B, 43A, and 43B can be manufactured.

According to the first preferred embodiment of the manufacturing if the nozzle plate 41, the punching process is carried out for the plate material 51 along the injection direction of fuel to provide through holes 52 and 53 and, thereafter, the one (major) surface 51A and the other (major) surface 51B are ground. Since, in the punching process, peripheral walls of the nozzle holes 42 and 43 can smoothly be finished with respect to the circulation direction of fuel.

During the grinding process, the shear droops 56, the defects 57, and fracture-plane 58 which are formed on both opening ends of the penetrated holes 52 and 53 can be scraped off together with a surface layer position of the plate material 51.

Upon the end of the grinding, the opening ends 42A, 42B, 43A, and 43B can be formed in the pointed edge configuration.

Furthermore, in a case where, for example, a bowing is developed on the plate material 51 with the pressure during the pressing, both front and rear (major) surfaces of the plate material 51 can be ground in parallel to each other to compensate for the bowing.

Hence, only by grinding both of the one surface 51A and the other surface 51B, the nozzle holes 42 and 43 of the nozzle plate 41 can be formed with a high accuracy so that the nozzle plate 41 of the stable form, in other words, of no manufacturing deviation can efficiently be manufactured.

During the fuel injection, the granulated fuel from the nozzle holes 42 and 43 can stably be injected toward a predetermined injection direction so that a performance as the fuel injection valve can be improved.

In this case, a constant correlation between the inclination angle and injection pattern (injection direction) of fuel can be provided. This permits an easy setting of the inclination angles of the nozzle holes 42 and 43 which provides a desired injection pattern through a desk calculation.

Furthermore, during the manufacture of the nozzle plate 41 in the case of the second embodiment, in a case where a jig such as the die 54 and the punch 55 is replaced with the new one during the manufacture of the nozzle plate 41, the edge forms of the nozzle holes 42 and 43 can be aligned irrespective of a deviation in characteristics of jigs and a yield (or productivity) of the fuel injection valve can be improved.

Figure 16:
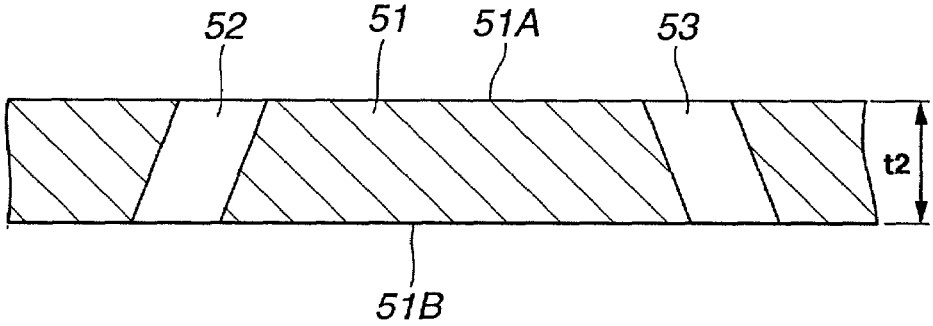
FIG. 16 is an expanded cross sectional view representing the plate material whose both front and rear surfaces are ground in the second embodiment shown in FIGS. 12, 13, and 14.

It is noted that, after the grinding process of the second embodiment manufacturing method for the nozzle plate shown in FIG. 16, the polishing process shown in the case of the first embodiment of the manufacturing method shown in FIG. 11 may be added.

Although, in the first embodiment of the manufacturing method for the nozzle plate, the grinding fluid 36 is used to form the arc-shaped chamfered portion 18 at the outflow opening ends of the nozzle holes 16 and 17, the present invention is not limited to this. For example, the outflow opening ends of the nozzle holes 16 and 17 may be polished with one of the various kinds of polishing tool, for example, the horning, the buff rolling for the outflow opening ends of the nozzle holes 16 and 17 to form arc-shaped chamfered portions 18.

The entire contents of a Japanese Patent Application No. 2000-246893 (filed in Japan on Aug. 16, 2000) are herein incorporated by reference. Although the invention has been described above by reference to certain embodiment of the invention, the invention is not limited to the embodiments described above. Modifications and variations of the embodiments described above will occur to those skilled in the art in the light of the above teachings. The scope of the invention is defined with reference to the following claims.

What is claimed is:

1. A fuel injection valve comprising:

a substantially cylindrical valve casing in which a fuel flow passage is provided in its axial direction;

a valve seat member comprising a valve seat installed within the fuel flow passage of one end of the cylindrical valve casing to enable a seating of a valve body and an injection outlet opening with a periphery of which the valve seat is enclosed, the valve body being disposed within the fuel flow passage of the valve casing to be operatively separated from the valve seat to open the fuel injection valve to inject the fuel in the fuel flow passage of the valve casing in response to an activation of an actuator;

a nozzle plate faced against the injection outlet opening and on both surfaces of which openings of a plurality of nozzle holes are formed, the fuel being injected through the nozzle holes when the fuel injection valve is open; and a smoothly chamfered portion in a substantially arc shape of cross section formed on an edge of an inner wall portion of each opening end of the corresponding nozzle hole of the nozzle plate to further expand a whole diameter of an injection stream of fuel passed through the nozzle holes;

wherein the dimension ratio between a hole diameter of each nozzle hole (d) at a substantially center of its corresponding nozzle hole and a radius of curvature of its corresponding arc-shaped chamfered portion (r) at the corresponding opening end is set to fall in a range from 1:0.1 to 1:0.28.

2. A fuel injection valve as claimed in claim 1, wherein the nozzle plate is substantially of a circular shape and the plurality of nozzle holes are extended substantially radially about a center of the nozzle plate and faced against the valve body via the injection outlet opening.

3. A fuel injection valve as claimed in claim 2, wherein each nozzle hole comprises an inlet opening at one of the surfaces of the nozzle plate faced against the valve body via the injection outlet opening and an outlet opening at the other surface thereof exposed to an external of the fuel injection valve, the outlet opening of each nozzle hole being offset toward a peripheral end of the nozzle plate with respect to a line parallel to a plate thickness direction of the nozzle plate passing through the center of the nozzle plate from the inlet opening of its corresponding nozzle hole.

4. A fuel injection valve as claimed in claim 3, wherein the substantially arc-shaped chamfered portion is formed on the edge of the inner wall portion of each outlet opening of its corresponding nozzle hole to gradually increase a diameter of its corresponding nozzle hole at the edge thereof.

5. A fuel injection valve as claimed in claim 3, wherein each nozzle hole is inclined by a predetermined inclination angle toward the peripheral end of the nozzle plate with respect to the plate thickness direction.

6. A fuel injection valve as claimed in claim 5, wherein the valve body is substantially of a spherical body, is biased to be seated on the valve seat with a valve spring linked to the valve body via a valve axle, and is separated from the valve seat against a biasing force of the valve spring in response to the activation of the actuator comprising an electromagnetic actuator.

7. A fuel injection valve as claimed in claim 6, wherein the arc-shaped chamfered portion of the inner wall of each nozzle hole is formed by circulating a fluid polish mixed with a polishing material through each nozzle hole to polish opening ends of the respective nozzle holes faced against the external of the fuel injection valve in a form of the substantially arc shape of cross section with the polishing material.

8. A fuel injection valve as claimed in claim 1, wherein the dimension ratio between the hole diameter (d) of each nozzle hole at the substantially center of its corresponding nozzle hole and the radius of curvature of its corresponding arc-shaped chamfered portion (r) is set to fall in a range from 1:0.14 to 1:0.2.

9. A fuel injection valve as claimed in claim 1, wherein the plurality of nozzle holes are formed by penetrating a punch through a plate material mounted on a die and inserting a tip of the punch into a punch hole of the die.

10. A fuel injection valve as claimed in claim 1, wherein the smoothly chamfered portion in a substantially arc shape of cross section formed on an edge of an inner wall portion of each opening end of the corresponding nozzle hole of the nozzle plate has no sharp edges.

11. A fuel injection valve comprising:

a substantially cylindrical valve casing in which a fuel flow passage is provided in its axial direction;

a valve seat member comprising a valve seat installed within the fuel flow passage of one end of the cylindrical valve casing to enable a seating of a valve body and an injection outlet opening with a periphery of which the valve seat is enclosed, the valve body being disposed within the fuel flow passage of the valve casing to be operatively separated from the valve seat to open the fuel injection valve to inject the fuel in the fuel flow passage of the valve casing in response to an activation of an actuator;

a nozzle plate faced against the injection outlet opening and on both surfaces of which openings of a plurality of nozzle holes are formed, the fuel being injected through the nozzle holes when the fuel injection valve is open; and a chamfered portion formed on an edge of an inner wall portion of each opening end of the corresponding nozzle hole of the nozzle plate to further expand a whole diameter of an injection stream of fuel passed through the nozzle holes, a cross section of the chamfered portion being in a substantially arc shape of convex geometry with respect to a central axis of the corresponding nozzle holes;

wherein the dimension ratio between a hole diameter of each nozzle hole (d) at a substantially center of its corresponding nozzle hole and a radius of curvature of its corresponding arc-shaped chamfered portion (r) at the corresponding opening end is set to fall in a range from 1:0.1 to 1:0.28.

12. A fuel injection valve comprising:

a substantially cylindrical valve casing including an axial fuel flow passage;

a valve seat member comprising a valve seat positioned in the fuel flow passage adjacent one end of the cylindrical valve casing to seat a valve body, the valve seat forming an injection outlet opening, the valve body configured to be operatively separable from the valve seat to open the fuel injection valve to inject the fuel in the fuel flow passage of the valve casing; and a nozzle plate facing the injection outlet opening, the nozzle plate having a plurality of nozzle holes formed therethrough, wherein fuel is injected through the nozzle holes when the fuel injection valve is open;

wherein at least a plurality of the nozzle holes include a smoothly chamfered portion including a substantially arc shape cross section formed at an end of the nozzle hole smoothing out the end of the nozzle hole and to expand an injection stream of fuel passed through the nozzle holes;

wherein the dimension ratio between a hole diameter of each nozzle hole (d) at a substantially center of its corresponding nozzle hole and a radius of curvature of its corresponding arc-shaped chamfered portion (r) at the corresponding opening end is set to fall in a range from 1:0.1 to 1:0.28.

* * * * *